United States Patent [19]

Trölltsch et al.

[11] Patent Number: 4,751,780

[45] Date of Patent: Jun. 21, 1988

[54] CUTTER BLOCK FOR DRY SHAVING APPARATUS

[75] Inventors: Karl Trölltsch, Frankfurt am Main; Werner Messinger, Kronberg, both of Fed. Rep. of Germany

[73] Assignee: Braun Aktiengesellschaft, Kronberg, Fed. Rep. of Germany

[21] Appl. No.: 911,579

[22] Filed: Sep. 25, 1986

[30] Foreign Application Priority Data

Sep. 25, 1985 [DE] Fed. Rep. of Germany ..... 3534166

[51] Int. Cl.[4] ..... B26B 19/02; B26B 19/04

[52] U.S. Cl. ..... 30/43.92; 30/346.51; 30/346.58

[58] Field of Search ..... 30/43.92, 346.51, 346.53, 30/346.58, 346.6, 346.61

[56] References Cited

U.S. PATENT DOCUMENTS

| | | | |
|---|---|---|---|
| 3,128,550 | 4/1964 | Miselli | 30/346.5 X |
| 3,154,851 | 11/1964 | Erickson | 30/346.51 X |
| 3,290,781 | 12/1966 | Kratz | 30/346.51 |
| 3,771,842 | 11/1973 | Messinger | 30/43.92 |

FOREIGN PATENT DOCUMENTS

| | | |
|---|---|---|
| 1553787 | 1/1971 | Fed. Rep. of Germany . |
| 2019744 | 11/1971 | Fed. Rep. of Germany . |
| 1221580 | 7/1986 | Fed. Rep. of Germany . |
| 48-42301 | 12/1973 | Japan . |
| 49-200 | 1/1974 | Japan . |

*Primary Examiner*—E. R. Kazenske
*Assistant Examiner*—Michael D. Folkerts

[57] ABSTRACT

The invention is directed to a cutter block for a dry shaving apparatus, having cutter blades of circular circumference arranged transversely to its longitudinal axis on a carrier, the cutter blades being received by a cylindrical metal-plastic carrier comprising a metallic core and a cylindrical plastic body encasing it closely and forming a compact unit therewith.

15 Claims, 1 Drawing Sheet

FIG.1
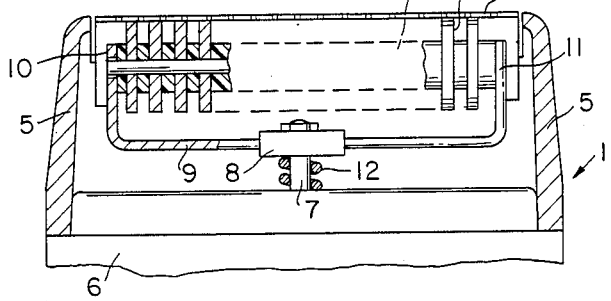
FIG.2
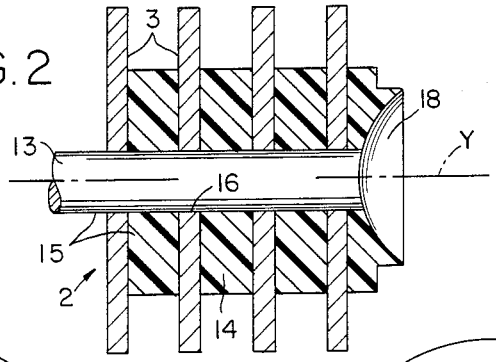
FIG.3
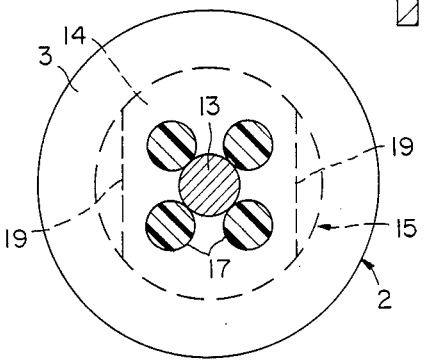
FIG.4
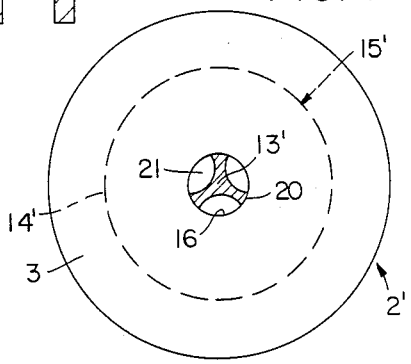
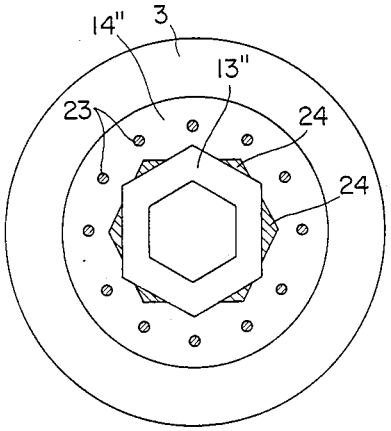
FIG.6
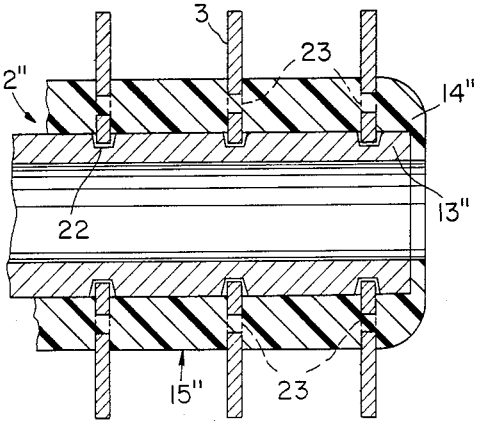
FIG.5

CUTTER BLOCK FOR DRY SHAVING APPARATUS

BACKGROUND OF THE INVENTION

This invention relates to a cutter block for dry shaving apparatus, including cutter blades of circular circumference arranged transversely to its longitudinal axis on a carrier.

In prior known cutter blocks of this type, a hollow cylinder is provided serving as the carrier of the annular cutter blades which—being equidistant from each other—are embedded in the hollow cylinder made of plastic or metal, for example, of aluminum. An axial collar provided on either end face of the hollow cylinder serves for the insertion of the cutter block so configured into circular recesses of a coupling bridge connected with the drive of the dry shaving apparatus and oscillating in the direction of longitudinal extension of the cutter block (Japanese Utility Model JP-GM No. 48-42301).

To displace the cylindrical cutter block for the specific purpose of positioning at least two diametrically opposite circumferential areas of the cutter after one half or one third of the effective cutter circumference is worn down, the carrier body has at its end face a triangular collar or suitable recesses for cooperation with corresponding recesses or projections on the coupling bridge receiving the cutter block (Japanese Utility Model JP-GM No. 49-200).

In the prior known construction of the cylindrical cutter blocks the configuration of the carrier has proved a problem, in particular where smaller cutter blocks with diameters in the range below 10 mm are used. While on the one hand the carrier has to be constructed to a thickness sufficient to avoid deflection of the cutter block under the shaving pressure and to ensure the necessary embedding depth for the cutter blades which is absolutely necessary to secure them in position on the carrier, compliance with these requirements on the other hand renders the carrier excessively heavy, particularly if it is made of metal, so that the scope of application of such cutter blocks is rather limited.

SUMMARY OF THE INVENTION

It is, therefore, an object of this invention to provide a F cutter block of the type initially referred to which, while being of low weight, can be maintained mechanically stable to resist deflection, which ensures a secure mounting of the cutter blades with good heat dissipation, and which can be manufactured at low cost in particular with small cutter blade diameters.

More specifically, it is an object of this invention to efficiently manufacture cutter blocks for dry shavers with cutter blades having a circular circumference and a diameter below 10 mm, preferably in the range of 6 mm, with the advantages of better shaving results, e.g., better guidance over the skin curvature, better shaving of wrinkled skin areas, while being relatively small and light.

This object is accomplished by the invention providing for the cutter blades to be received by a cylindrical metal-plastic carrier comprising a metallic core and a cylindrical plastic body encasing it closely and forming a compact unit therewith.

Such a metal-plastic carrier for holding the circular cutter blades of the cutter block is characterized by its good stability, because the close bond between its metallic core and the plastic body material applied by injection molding results in a carrier unit which is of extremely high flexural strength and non-distorting properties. In addition, the circular cutter blades to be optimally anchored to this metal-plastic carrier, owing to their polydirectional location in the carrier material, have consistently good flexibility in any direction and consistently good shearing quality at any point of their cutting edges. Finally, these cutter blades can be manufactured to an extremely high degree of precision relatively simply by cylindrical grinding after the cutter blades have been assembled into the cutter block in accordance with this invention. Cylindrical grinding also enables the cutter blades to be manufactured to relatively small diameters which, in turn, permits the manufacture of similarly small cutter blocks. Accordingly, the cutter blocks of the invention permit shearing systems of relatively small dimensions which are distinguished for conforming particularly well to those contours of the user's skin that are identified as problem zones.

More specifically, the cutter blades of the invention are anchored in the metallic core of the metal-plastic carrier by retaining means arranged on the core circumference at predetermined relative distances.

This arrangement results in a durable location and bearing and an accurate positioning of the cutter blades directly on the metallic core of the metal-plastic carrier of the cutter block.

However, the same effect can be achieved if the cutter blades have their concentric inner edges directly seated on the metallic core of the metal-plastic carrier and are positioned thereon in a mold serving for the manufacture of the cutter block before the material forming the plastic body is injection-molded around the core.

This arrangement, too, ensures a secure location and bearing of the cutter blades on the metallic core of the metal-plastic carrier, with the lateral support these blades receive by the material of the plastic body encasing the core eliminating the need for special retaining means in the metallic core.

Moreover, a particularly good location of the individual cutter blades of the cutter block in the metal-plastic carrier is accomplished by providing the cutter blades with preferably cloverleaf cutouts arranged symmetrically to their concentric inner edges directly surrounding the metallic core, these cutouts allowing passage of the liquid plastic material during injection molding of the plastic body to fill the chambers defined by the cutter blades until the plastic body has reached the desired thickness.

The metallic core of the cutter block may embody different forms. Thus, in particular with a view to securely locating the metallic core in the plastic body encasing it, it is an advantage to configure the metallic core of the cutter block as a profiled bar of polygonal cross section having longitudinal grooves throughout its length while its ribs correspond with the inner edges of the cutter blades. In the mold, this embodiment also allows the liquid material forming the plastic body—establishing a positive connection with the profiled bar—to flow through the longitudinal grooves into the spaces intermediate the cutter blades.

In a practical modification of the subject of the invention in which the cutter blades are anchored to the metallic core, the metallic core of the cutter block is particularly advantageously formed of a tube having on its circumferential surface equidistantly spaced annular mounting grooves for insertion and positioning of the individual cutter blades.

For securely locating the cutter blades thus anchored to the metallic core in the metal-plastic carrier assembly of the cutter block, the cutter blades positioned in, and in positive engagement with, the mounting grooves provided on the circumferential surface of the tubular metallic core have recesses which in the mold are penetrated by the still liquid material of the plastic body encasing this tube.

Finally, it is within the scope of this invention to manufacture the metal-plastic carrier of the cutter block by pressing the metallic core in the mold after the injection molding process into the plastic body having a concentric axial bore.

BRIEF DESCRIPTION OF THE DRAWINGS

An embodiment of the invention encompassing several modified forms will be explained in more detail in the following with reference to the accompanying drawing, wherein:

FIG. 1 shows the shearing head of a dry shaving apparatus having a cylindrical cutter block driven by an oscillating coupling bridge;

FIG. 2 is a longitudinal sectional view of the cutter block;

FIG. 3 is a top plan view of the end face of the cutter block of FIG. 2;

FIG. 4 is a top plan view of the end face of the cutter block illustrating a modified form thereof;

FIG. 5 shows another modified form of the cylindrical cutter block of the invention; and FIG. 6 is a sectional view of the cutter block of FIG. 5.

DESCRIPTION OF THE PREFERRED EMBODIMENT

FIG. 1 generally shows the shearing head 1 of a dry shaving apparatus having a cylindrical cutter block 2 whose circular cutter blades 3 are arranged to cooperate with a shearing foil 4 mounted in a shearing head frame 5 which is adapted to be seated on a flange of the casing 6 of the dry shaving apparatus.

The casing 6 houses a vibrating armature motor, not shown, which drives via a rocking lever 7 and an elastic coupling means 8 a U-shaped coupling bridge 9 receiving the cutter block 2. In this arrangement, this is accomplished by a collar 10 formed on either end face of the cutter block 2 and engaging into a respective forked end 11 of the coupling bridge 9. A compression spring 12 which is operatively associated with, and bears against, the elastic coupling means 8 resiliently urges the cutter block 2 secured in position in the coupling bridge 9 in the manner described into engagement with the shearing foil 4 mounted in the shearing head frame 5 by snap fasteners, for example.

As becomes apparent from FIG. 2 showing the cutter block 2 in longitudinal section, the cutter block 2 comprises a metallic or metallized core 13 concentrically encased by a rotationally symmetrical body 14 of plastic material. The individual cutter blades 3 are placed on the metal-plastic carrier 15 thus formed, such that their concentric inner or perforated edges 16 are in direct seating engagement with the core 13. As shown more clearly in FIG. 3, the inner edges 16 of the cutter blades 3 have cloverleaf cutouts 17 which in the manufacture of the cutter block 2 allow the passage of the still liquid plastic molding material forming the body 14, whereby the spaces intermediate the cutter blades 3 are filled and a solid connection is formed by the body 14 embedding the cutter blades 3 which, on the other hand, bear directly against the metallic core 13.

FIG. 3 which is a top plan view of the end face of the cutter block 2 on the side closed by the cutter blade 3 shows still more clearly how each individual cutter blade 3 is integrated into the metal-plastic carrier 15 by being embedded into the plastic body 14 by means of its cloverleaf cutouts 17 through which in the manufacturing process the plastic molding material flows, the cutouts bordering directly on the metallic core 13 of the carrier 15 and surrounding it symmetrically.

In the manufacturing process mentioned above, not only the cutter blades 3 but at the same time also the metallic core 13 is embedded in the plastic body 14 or is firmly encased by the latter, which is accomplished, for example, by centering the parts in a mold used in the manufacture of the cutter block 2.

By turning about its longitudinal axis y, the cylindrical cutter block 2 permits the selective use of different sections of its cutter blades 3 for cooperation with the shearing foil 4 of the dry shaving apparatus. The displacement of the cutter block 2 within the forks 11 of the coupling bridge 9 necessary for this purpose is facilitated by grip depressions 18 provided on the end faces of the metal-plastic carrier 15 which allow the cutter block to be grasped safely for displacement or exchange.

To secure the cutter block 2 in its new position of use following such displacement or exchange, the metal-plastic carrier 15 has on its circumference in its area of engagement with the forks 11 of the coupling bridge 9 two parallel centering surfaces 19 which cooperate with corresponding parallel guiding surfaces of the forks 11 for the cutter block 2, thereby permitting a speedy and trouble-free adjustment of the desired shearing zone.

An alternative solution in respect of the manufacture and configuration of the cylindrical cutter block is shown in FIG. 4. In this FIG., the metal-plastic carrier 15′ of the cutter block 2′ is composed of a metallic core 13′ configured as a profiled bar and of a cylindrical plastic body 14′ closely connected therewith. The individual cutter blades 3 are seated on the metal-plastic carrier F 15′ so configured, having their inner or perforated edges 16 in abutment with the ribs 20 of the profiled metallic core 13′ and bearing thereagainst.

The cylindrical cutter block 2′ configured in this manner is also manufactured by injection molding in which process the metallic core 13′ configured as a profiled bar is centered in a mold, whereupon the plastic molding material forming the plastic body 14′ flows through the longitudinal grooves 21 of the metal core 13′ which in this embodiment is three sided, thereby providing, as in the example previously described, an intimate connection between the core and the plastic body 14′ surrounding it on all sides and the cutter blades 3 seated directly on the core 13′. In this arrangement, the cutter blades 3 are self-centering on the profiled core 13′ of the metal-plastic carrier 15′.

FIGS. 5 and 6 finally show another alternative form of a cutter block of the invention. In these FIGS., the metallic core 13″ of the metal-plastic carrier 15″ is formed of a tube having on its circumference evenly spaced annular grooves 22 for insertion and positioning of the individual cutter blades 3 of the cutter block 2″.

The metallic core 13'' has the material of the plastic body 14'' molded around it completely or is embedded therein, forming a compact body therewith, that is, the metal-plastic carrier 15'' for the cutter blades 3 of the cutter block 2''. In this arrangement, the cutter blades 3 have bores or recesses 23 invariably arranged at the same level and which in the manufacturing process are penetrated by the still liquid plastic material of the plastic body 14'', as a result of which the cutter blades, in addition to being permanently secured in position in the core 13'' of the cutter block 2'', are anchored in the plastic body 14'' in a particularly solid and positionally accurate manner.

As best seen in FIG. 6, the metallic core 13'' is a tube having a polygonal, such as hexagonal, cross section. The inner edges of the cutter blades 3, defines a hexagonal opening which corresponds to the outer hexagonal shape of the metallic core 13''. Each cutter blade 3 is aligned and positioned over the metallic core 13'' and turned into the position shown in FIG. 6. The plastic body 14'' is then formed with the recesses 23 and formed recesses 24 as part of the plastic body 14''.

It is within the scope of this invention to provide the profiled bar or tube forming the metallic core of the cutter block with a polygonal, for example, tetragonal or hexagonal, profile which has the advantage of enabling the cutter block assembly to be set to a variety of predetermined positions to allow the use of several circumferential areas of the cutter blades, this being accomplished by turning and inserting the cutter block within correspondingly formed recesses in the coupling means 8 carrying the cutter block.

While embodiments and applications of this invention have been shown and described, it will be apparent that many more modifications are possible without departing from the inventive concept herein described. The invention, therefore is not to be restated except as is necessary by the prior art and by the spirit of the appended claims.

What is claimed as new and desired to be secured by Letters Patent of the United States is:

1. A cutter block for a dry shaver comprising an elongated metallic core;

a plurality of metallic cutter blades disposed in spaced relation on said metalic core, each said cutter blade having a circular circumference and inner edge, said inner edge structure of each said cutter blade being in contact with said metallic core, at least one of said core and cutter blades having structure defining longitudinallly extending passage portions; and a body of plastics matrial substantially encasing said metallic core with a portion of each said cutter blade being embedded in said body of plastics material, said body of plastics material including spacer portions that are disposed between adjacent cutter blades and maintain said cutter baldes in spaced relation on said metallic core and integral coupling portions that extend through said longitudinally extending passage portion and interconnect said spacer portions.

2. The cutter block as in claim 1 wherein each of said inner edge structure is directly seated on said metallic core.

3. The cutter block as in claim 1 wherein the diameter of each of said cutter blades is below one centimeter.

4. The cutter block as in claim 1 wherein said metallic core includes a plurality of annular grooves for mounting said cutter blades.

5. The cutter block as in claim 4 wherein said annular grooves are equidistantly space along said elongated metallic core.

6. The cutter block as in claim 5 wherein said elongated metallic core is of tubular configuration.

7. The cutter block as in claim 1 wherein each of said cutter blades includes a plurality of openings that provide said longitudinally extending passage portions and in which said integral coupling portions of said body of plastics material are disposed.

8. The cutter block as in claim 1 wherein each of said cutter blades are provided with a plurality of cut-outs symmetrically arranged around its inner edge that provide said longitudinally extending passage portions, said cut-outs being encased in said body of plastics material and said integral coupling portions being disposed in said cutouts.

9. The cutter block as in claim 8 wherein said plurality of cut-outs are four in number and form a clover leaf.

10. The cutter block as in claim 1 wherein said elongated metallic core includes a plurality of longitudinal grooves throughout its length that provide said longitudinally extending passage portions and are filled with said plastics material.

11. The cutter block as in claim 10 wherein said metallic core includes ribs in contact with each of said inner edges of said cutter blades.

12. The cutter block as in claim 11 wherein said elongated metallic core is configured as a profiled bar of general polygonal cross-section, said longitudinal grooves being filled with said plastics material.

13. The cutter block of claim 7 wherein the diameter of each of said cutter blades is below one centimeter and an inner edge portion of each said cutter blade is seated directly on said metallic core.

14. The cutter block of claim 8 wherein the diameter of each of said cutter blades is below one centimeter and an inner edge portion of each said cutter blade is seated directly on said metallic core.

15. The cutter block of claim 12 wherein the diameter of each of said cutter blades is below one centimeter, an inner edge portion of each said cutter blade is seated directly on said metal core and said integral coupling portions of said body of plastics material are disposed in said grooves of said metallic core.

* * * * *